United States Patent [19]

Sastry et al.

[11] Patent Number: 4,482,375

[45] Date of Patent: Nov. 13, 1984

[54] LASER MELT SPIN ATOMIZED METAL POWDER AND PROCESS

[75] Inventors: Shankar M. Sastry, Chesterfield; James E. O'Neal, Bridgeton; Tzy C. Peng, St. Louis, all of Mo.

[73] Assignee: McDonnell Douglas Corporation, St. Louis, Mo.

[21] Appl. No.: 558,204

[22] Filed: Dec. 5, 1983

[51] Int. Cl.[3] ..... B22D 23/08

[52] U.S. Cl. ..... 75/0.5 C; 264/8; 264/10; 264/12

[58] Field of Search ..... 75/0.5 B, 0.5 BA, 0.5 BB, 75/0.5 C; 264/8, 10, 12

[56] References Cited

U.S. PATENT DOCUMENTS 4,014,964 3/1977 Probst et al. ..... 264/10

4,218,410 8/1980 Stephan et al. ..... 264/8

4,374,075 2/1983 Yolton et al. ..... 264/10

*Primary Examiner*—W. Stallard

*Attorney, Agent, or Firm*—Rogers, Eilers & Howell

[57] ABSTRACT

A method of producing rapidly solidified metal powder utilizes a spinning metal source and a laser beam to melt the surface layer of the source and atomize it. The laser beam is directed at a glancing angle along the surface of the spinning metal source. The source spins at a high speed of 10,000–30,000 revolutions per minute. The atomized metal is solidified rapidly in an inert gas atmosphere. Very high cooling rates up to $10^{6}$° C. per second can be achieved. Very small and uniformly distributed particles of rapidly solidified metal can be obtained having a narrow particle size distribution from about 50–150 microns and typically having a high percentage of the particles at a particle size of below 100 microns.

11 Claims, 4 Drawing Figures

LASER MELT SPIN ATOMIZED METAL POWDER AND PROCESS

BACKGROUND AND SUMMARY OF THE INVENTION

Powder metallurgy techniques, for example for aluminium and titanium forming, are well known in the art. Rapid solidification techniques, such as electron beam melting-splat quenching techniques, utrasonic gas atomization and various rotating electrode processes are commonly used. These processes are normally suitable to produce cooling rates in excess of $10^{3°}$ C. per second, and in some cases nearly $10^{5°}$ C. per second.

Applicants have found, however, that by using a laser beam aimed at a glancing angle radially across a rotating surface of a metal body, such as aluminum and titanium, cooling rates greatly above $10^{3°}$ C. per second may be achieved. Rates of $10^{6°}$ C. per second can be achieved with a forced convection cooling using an inert gas, such as helium or argon, and high rotational speed of the metal source. This technique also has the unexpected advantage of producing metal powders of very small flake or spherical particle size, a substantial portion of which are below 100 microns in size. Typically the particles will be distributed between 50 and 150 microns in size.

The process is unique, in that a very high porportion of the particles produced are below 100 microns in size, and are very closely grouped in particle size. The resulting particles are highly useful in producing composite structures, The close grouping allows fabrication of structures with reduced waste, resulting in lower component cost and efficient material utilization. Often it is not necessary to sieve or segregate the powders prior to formation into structures. The structures formed from the resulting particles have a high strength and overall performance.

Another advantage that we have found with this process is there is very little contamination during the powder making process. In particular, there is substantially no tungsten contamination, as does result with other processes. As a result, the mechanical properties of the material, particularly titanium, are improved. Moreover, as a result, applicants' process produces powders which can be used to make alloys not possible with other methods.

Applicants have found the following U.S. Patents, the disclosures of which are incorporated by reference herein:

U.S. Pat. No. 1,915,201
U.S. Pat. No. 2,997,245
U.S. Pat. No. 3,014,812
U.S. Pat. No. 3,429,295
U.S. Pat. No. 3,539,221
U.S. Pat. No. 3,594,261
U.S. Pat. No. 3,827,805
U.S. Pat. No. 3,839,012
U.S. Pat. No. 3,963,812
U.S. Pat. No. 4,113,492
U.S. Pat. No. 4,259,270
U.S. Pat. No. 4,264,421
U.S. Pat. No. 2,267,208
U.S. Pat. No. 4,276,463
U.S. Pat. No. 4,289,952

DESCRIPTION OF THE PREFERRED EMBODIMENTS

Figure 3:
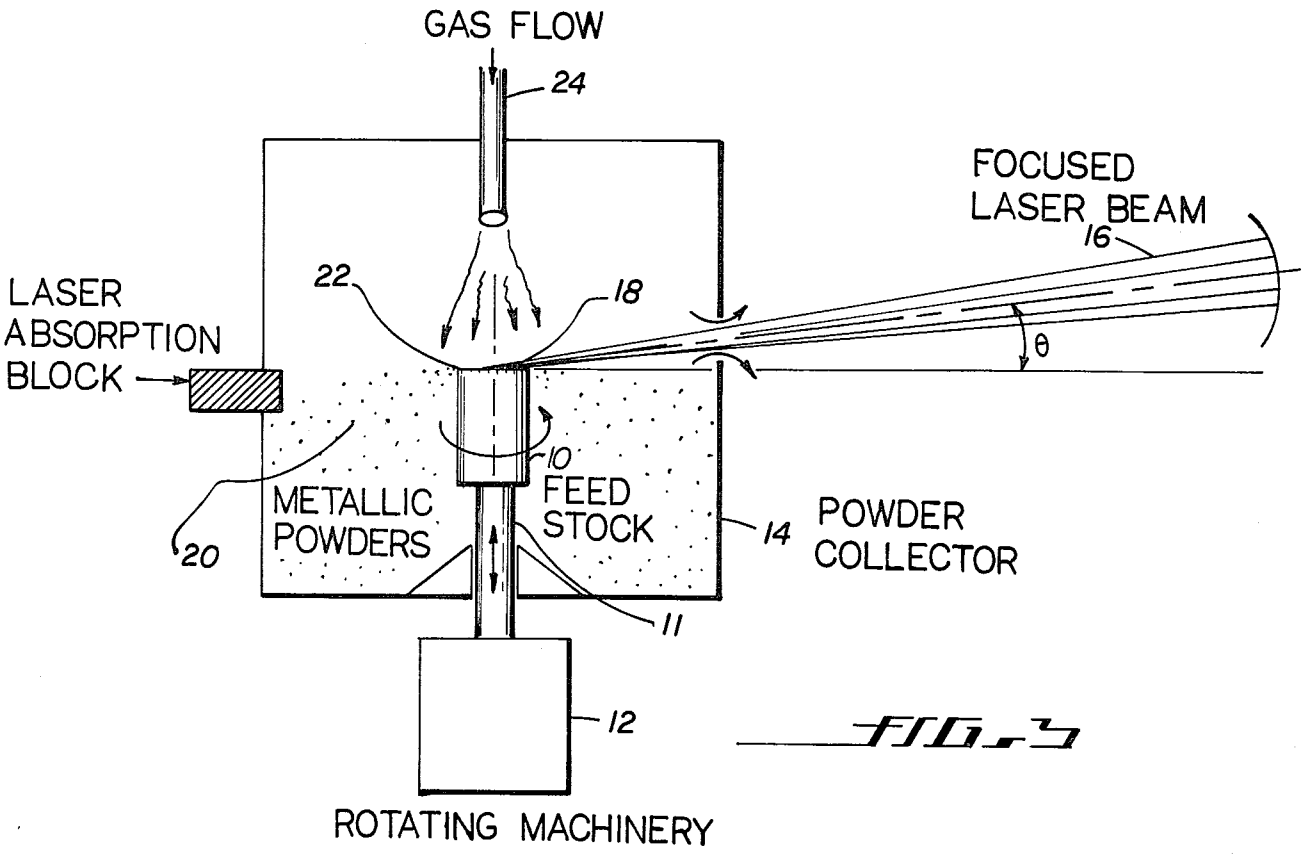
FIG. 3 is a schematic diagram of applicants' method.

As shown in FIG. 3, the feed stock material 10 is shaped into a body of revolution and secured to the shaft 11 of a high speed moter or turbine 12. Motor 12 can rotate at variable high speeds up to 30,000 r.p.m. or more. The feed stock 10 is positioned inside a powder collector 14, so that a focused laser beam 16 can be directed radially across the surface 18 of the feed stock 10. Beam 16 is positioned at a small glancing angle, typically between 3° to 10°, the angle is not critical. The laser beam 16 melts only a thin layer at the top surface 18 of the feed stock 10. Since the feed stock 10 is rotating at very high speed, the centrifugal force, generated by the rotation, spreads the molten surface layer radially outward and atomizes the molten metal into fine droplets 20 at the feed stock rim 22. These droplets 20 cool immediately after they break loose from the feed stock 10. It is believed that applicants' laser melting process is able to achieve a higher degree of superheat, and a resulting lower viscosity, in the metal melt than conventional processes. The less viscous melt atomizes into much finer droplets than produced by conventional processes.

Initial cooling of droplets 20 takes place by radiation and convection. At temperatures much below 700° C., convection becomes the primary cooling mechanism. The rate of convection cooling can be controlled by the rate flow of inert gas from source 24 inside the powder collector 14. The gas can be either inert or partially reactive with respect to the feed stock material, as required. Applicants have had good results at volume flow rates of inert gas of between about 5–10 $ft.^3$/minute through an enclosure displacing about one cubic foot.

Using this method, extremely high cooling rates, up to $10^{6°}$ C. per second, can be achieved and particles can be produced down to 50 microns in diameter. The metallic powders produced can be either in spherical or in splat or flake form. The spherical powders result from cooling by radiation and convection and result in solidification of the molten droplets 20 in flight before they hit the wall of collector 14. The splats are formed if the solidification occurs after the droplets 20 hit the wall of collector 14.

Figure 1:
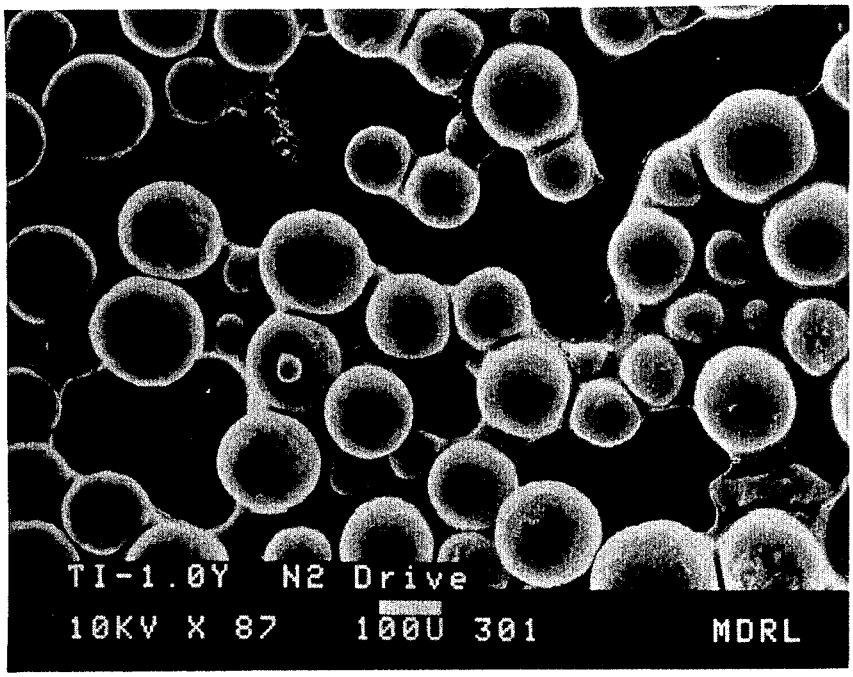
FIG. 1 is a photomicrograph of applicants' laser melt rapidly solidified titanium powder.
Figure 2A:
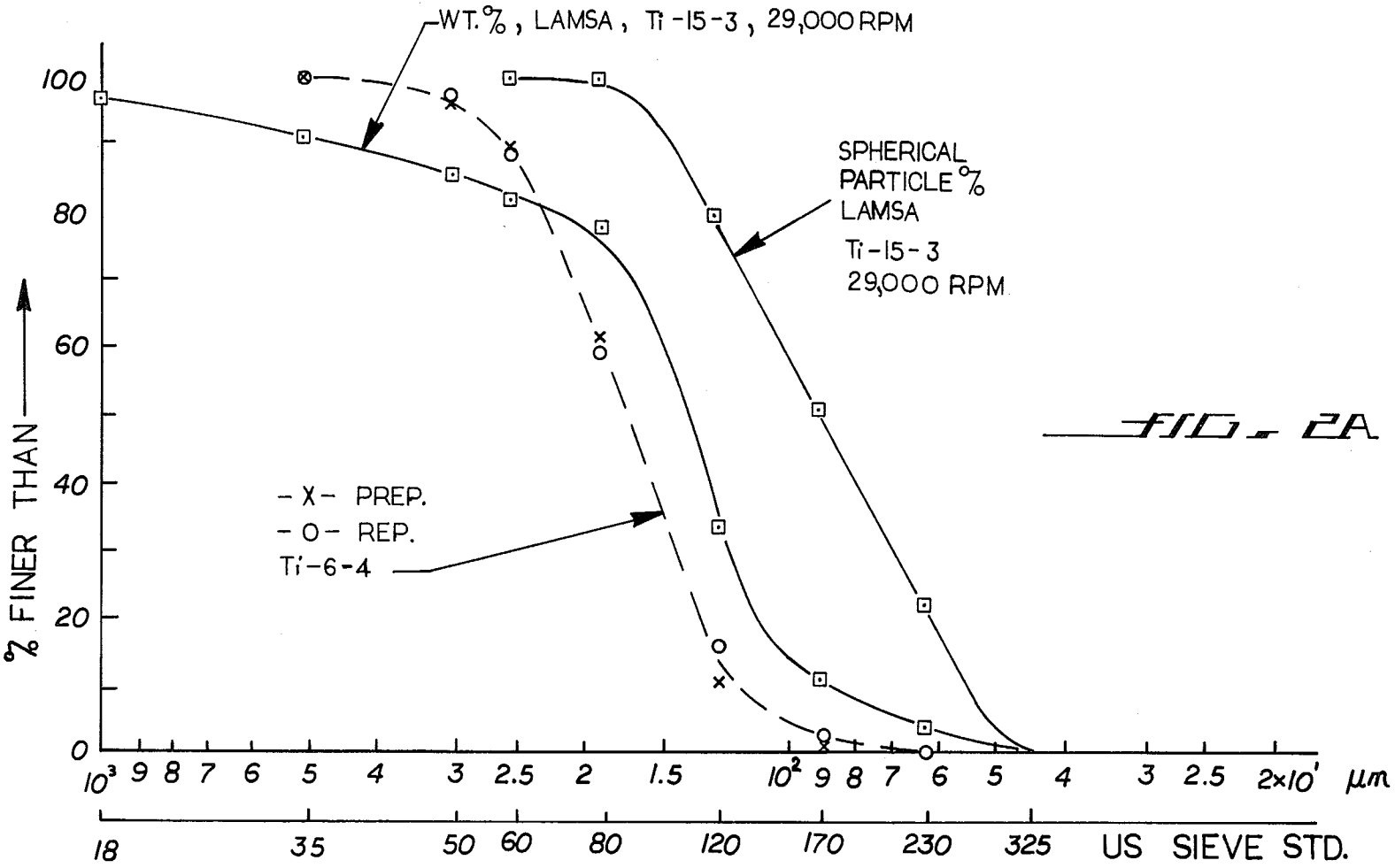
FIGS. 2A and 2B are graphs showing particle distribution of applicants' rapidly solidified powder produced at various rotational speeds.
Figure 2B:
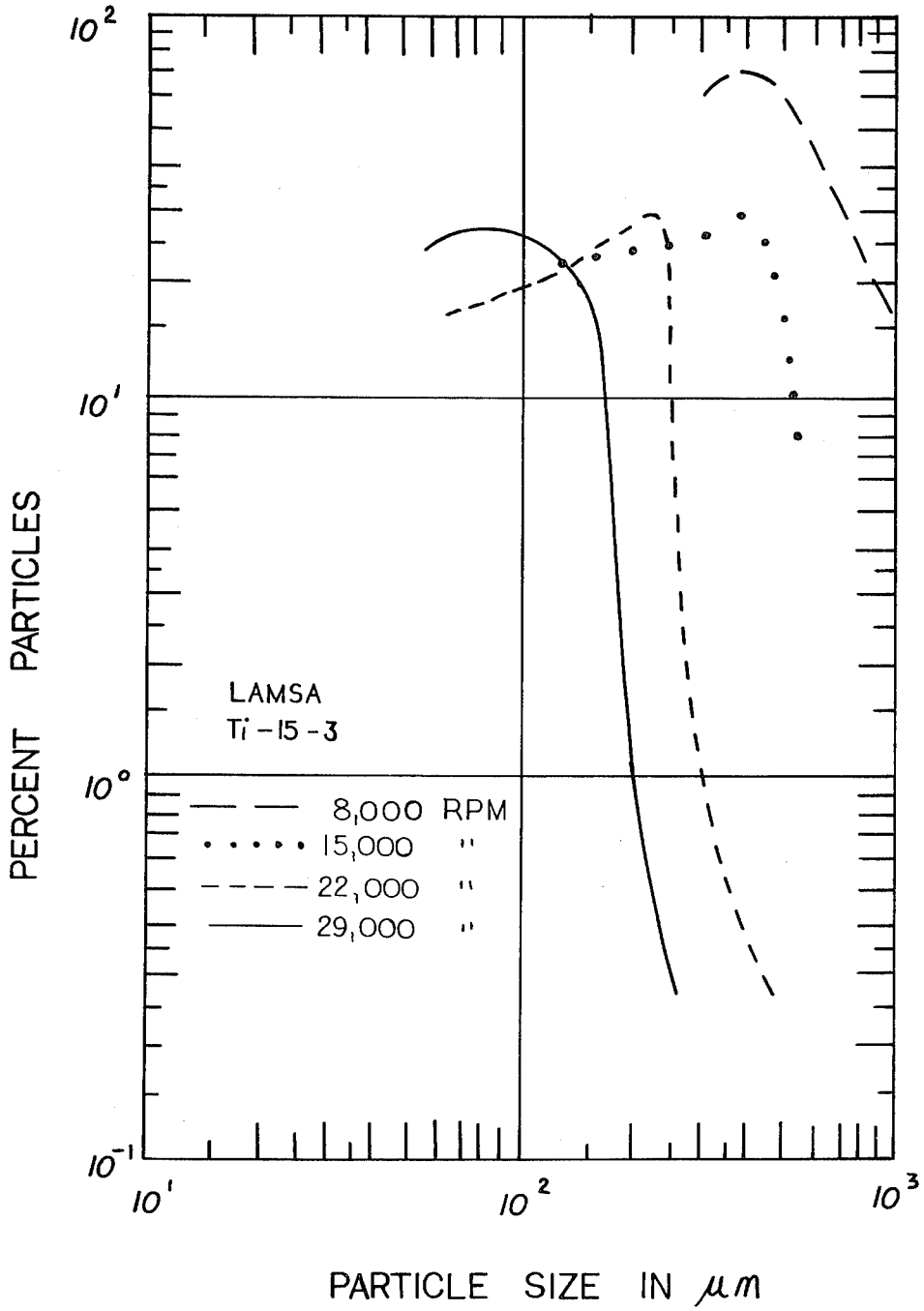

By controlling the rotational speed, and gas flow and cooling rate, powders can be formed at particle sizes having a diameter from 50 up to 500 microns. A particular significant result using applicants' method, is that the particles formed can be produced in a very narrow range of particle sizes. State of the art rapid solidification techniques typically produce particles having diameters greater than 200 microns and distributed over a wide range of particle sizes. As shown in FIG. 2A, these particles produced by conventional processes, such as rotating electrode (REP) and plasma rotating electrode (PREP) processes or electron beam rotating disc (EBRD) processes, may be distributed between about 50 and 500 microns in size. In contrast, with applicants' process (LAMSA), approximately half the particles may be less than 200 microns in diameter. It is possible, with applicants' process, to produce an array of particles substantially all of which are below 200 microns in diameter with a very high porportion being below 100 microns in diameter, as much as 75%. FIG. 2B shows the particle grouping for titanium-15-3 alloy particles formed by applicants' process using a 15 Kw CW $CO_2$ laser generator and a variety of settings for rotational speed.

It will be apparent to those skilled in the art that many variations and departures from the specific methods described herein may be made without departing from the spirit and essential characteristics of the invention. The scope of the invention is to be determined by the claims which are appended hereto and their equivalents.

I claim:

1. A method of melting and rapidly solidifying metals comprising rotating a body of the metal stock, impinging a laser beam on the surface of the rotating stock, the laser beam being disposed transversely across the surface of the rotating body of stock, to melt a thin film of metal from the surface of the rotating body, rotating the body at a speed effective to disperse the melted film from the periphery of the rotating body and atomize it into fine droplets and cooling and solidifying the droplets to form a metal powder.

2. The method of claim 1 wherein the laser beam impinges on the rotating metal stock surface at a slight angle.

3. The method of claim 2 wherein the angle of impingement is between about 3 and 10 degrees.

4. The method of claim 1 wherein the stock body is a volume of revolution and is rotated at a rotational speed of between about 10,000 and 30,000 revolutions per minute.

5. The method of claim 1 wherein the atomized droplets are cooled into spherical particles having a diameter of between about 50 and 250 microns.

6. The method of claim 1 wherein the metal body is atomized in an inert gas atmosphere.

7. The method of claim 1 wherein the metal particles have a particle distribution such that substantially all of the particles are below 200 microns in diameter.

8. The method of claim 7 in which the particle size distribution is such that substantially all of the particles have a particle size between 50 and 150 microns in diameter.

9. The method of claim 1 wherein the particle size of the particles produced is controlled by controlling the speed of revolution of the rotating body.

10. The method of claim 1 wherein the rate of convection cooling is controlled by controlling the flow rate of the inert gas atmosphere in which the droplets are atomized.

11. The method of claim 1 wherein the droplets are solidified in flight.

* * * * *